US006657152B2

(12) United States Patent
Shimazu

(10) Patent No.: US 6,657,152 B2
(45) Date of Patent: Dec. 2, 2003

(54) TORCH HEAD FOR PLASMA SPRAYING

(75) Inventor: Tadahiro Shimazu, Gifu (JP)

(73) Assignee: Shimazu Kogyo Yugengaisha, Gifu (JP)

( * ) Notice: Subject to any disclaimer, the term of this patent is extended or adjusted under 35 U.S.C. 154(b) by 0 days.

(21) Appl. No.: 10/197,096

(22) Filed: Jul. 17, 2002

(65) Prior Publication Data

US 2003/0042232 A1 Mar. 6, 2003

(30) Foreign Application Priority Data

Sep. 3, 2001 (JP) ..... 2001-265979

(51) Int. Cl.[7] ..... B23K 9/00

(52) U.S. Cl. ..... 219/121.47; 219/76.16; 219/121.52; 427/46

(58) Field of Search ..... 219/121.47, 76.15, 219/76.16, 121.51, 121.52, 121.5, 74, 75, 121.48; 427/446, 476, 569; 118/723 DC

(56) References Cited

U.S. PATENT DOCUMENTS

| | | | | |
|---|---|---|---|---|
| 3,823,302 A | * | 7/1974 | Muehlberger | 219/121.52 |
| 4,661,682 A | | 4/1987 | Gruner et al. | 219/121 PL |
| 4,877,937 A | | 10/1989 | Müller | 219/121.59 |
| 5,328,516 A | * | 7/1994 | Dietiker | 118/723 DC |
| 5,837,959 A | | 11/1998 | Muehlberger et al. | 219/121.47 |
| 5,938,944 A | * | 8/1999 | Baughman et al. | 219/76.16 |

FOREIGN PATENT DOCUMENTS

| | | |
|---|---|---|
| JP | 57-084778 | 5/1982 |
| JP | 09-217164 | 2/1996 |
| JP | 2001-043996 | 2/2001 |
| JP | 2001-052893 | 2/2001 |

* cited by examiner

*Primary Examiner*—Mark Paschall
(74) *Attorney, Agent, or Firm*—Perkins, Smith & Cohen LLP; Jerry Cohen

(57) ABSTRACT

A torch head includes a torch body which is inserted into the tube member, a cathode tube which is arranged in the torch body such that the longitudinal axis of the cathode tube is aligned to the longitudinal axis of the torch body and which has a cathode at the distal end of the cathode tube, an anode member which is arranged on the distal end side of the cathode tube, and a spraying material supply tube which opens toward a mouth opening formed in the anode member and which is arranged outside the torch body. In the anode member, a plasma gas supply chamber in which the front end of the cathode tube is stored in a non-contact state, an orifice which communicates with the plasma gas supply chamber and in which the cathode is stored in a non-contact state, and a plasma generation chamber which communicates with the orifice, which has a longitudinal axis substantially perpendicular to the longitudinal axis of the torch body, and which has the mouth opening are formed. The opening area of the orifice when the anode is inserted is made ⅓ to 1/10 the opening areas of the plasma (generation chamber and the mouth opening so that an arc from the distal end of the cathode is generated within a range of 0° to 40° with respect to the longitudinal axis of the plasma generation chamber perpendicular to the longitudinal axis of the cathode.

2 Claims, 7 Drawing Sheets

TORCH HEAD FOR PLASMA SPRAYING

BACKGROUND OF THE INVENTION

1. Field of the Invention

The present invention relates to a torch head for plasma spraying and, more particularly, to a torch head which is inserted into a tube member having a very small diameter to form a film by complete spraying on the inner surface of the tube member.

2. Prior Art

As torch heads for forming coatings by plasma splaying on inner surfaces of tube members, various torch heads have been proposed already. For example, in U.S. Pat. No. 4,877,937, a "plasma spray torch" as shown in FIG. 4 is proposed. This spray torch, according to the brief of the above publication, is described as follows "a plasma spray torch comprises a spray nozzle which forms an electrode and which includes a nozzle duct, and a second electrode associated therewith, in a portion of a torch arm, which is electrically insulated from the spray nozzle. The torch arm has flow passages for working gas and for a cooling agent, the latter flowing in one of the flow ducts to the nozzle and being removed after producing its cooling effect from another flow duct. A powder feed conduit opens into the nozzle duct. The working gas flow duct is connected to a duct which passes through the second electrode while at least in the region of its mouth opening, the nozzle duct is inclined relative to the longitudinal axis of the torch arm or the flow duct therein. In a method of internally coating a tube by plasma spraying, the torch is introduced into the tube which is then rotated and moved axially relative to the torch during the spray operation".

In a conventional torch head as shown in FIG. 4, since working gas (changed into a plasma by a discharge arc and heated to such a temperature that a powder can be melted) passage must be formed in a cathode, a cooling agent for cooling the cathode side cannot be formed in the cathode.

In the conventional torch head shown in FIG. 4, since the nozzle duct is inclined relative to the longitudinal axis of a flow duct, melted spraying material cannot perpendicularly collide with the inner wall surface of a tube material. For this reason, the spraying material is partially scattered without forming a coating, and it is considered that an excess of material must be used to form a satisfactory coating.

For this reason, for example, a "plasma spray gun" is proposed in Japanese Patent Publication No. 3-57833. This spray gun, according to FIG. 5 and "Claims" in the above publication, "is a plasma spray gun which is inserted into a pipe or an object to be processed and which includes a cooled electrode 10 and a burner nozzle 12 for coating the inner surface of the object to be processed, and is characterized in that 10 kw can be obtained at the most."

A satisfactory coating cannot be obtained when a plasma energy is small for the following reason. Since a spraying material is supplied into plasma working gas together with gas, the spraying material is a powder having an average grain diameter of 5 to 45 $\mu$m to make it easy to supply the spraying material. When the spraying material has a grain diameter of 5 $\mu$m or smaller, not only is the spraying material very expensive, but the spraying material may also combine with oxygen and nitrogen in the air and thus fail to form an expected coating. When the spraying material has a grain diameter of 45 $\mu$m or more, the spraying material is not sufficiently melted by the plasma working gas. When the spraying material comprises the powder is to be melted, and an arc is small and short, the working gas is not sufficiently changed into a plasma and a high temperature is not achieved, and the spraying material is not sufficiently melted. In addition, since the injection speed of the working gas cannot be considerably high, the kinetic energy of the spraying material must be small, and a collision energy sufficient to form a coating cannot be obtained.

For this reason, the present inventor investigated a torch head shown in FIG. 6 or 7. In the torch head shown in FIG. 6, a plasma generation chamber is perpendicular to the longitudinal axis of the torch body, and a cathode is coaxially arranged in the plasma generation chamber. Although a high-energy plasma can be generated, it is difficult to set the diameter of the entire torch head such that the torch head can be inserted into a tube member having an inner diameter of about 50 mm. This is because, when the torch head is to be reduced in size, the distance between the cathode and the anode member must be reduced, and a high voltage cannot be applied across these electrodes. In addition, the cooling passage is limited, and a high-energy plasma cannot be generated.

On the other hand, in the torch head shown in FIG. 7, a cathode is coaxially arranged in a torch body, and the distance between the cathode and the anode member can be increased such that a high-energy plasma can be generated. However, since the passage of a plasma gas is bent at an angle of 90°, the anode member is considerably worn. This is because, a high-temperature working gas changed into a plasma by an arc generated between the cathode and the anode member collides with the wall of the passage which is formed in the anode member and which is bent at an angle of 90° to heat the wall portion and to wear the wall portion within a short period of time.

In addition, the present inventor devised a torch head shown in FIGS. 8 and 9 to improve the above torch head. The torch head shown in FIGS. 8 and 9 has a plasma gas supply chamber located in an anode member along the longitudinal axis of the anode member. A cathode is coaxially arranged in the plasma gas supply chamber, and a mouth opening to be perpendicular to the longitudinal axis of the plasma gas supply chamber is formed on the side surface of the anode member. In this manner, it is considered that an arc toward the mouth opening is generated. In fact, at the beginning of the use of the torch head, "distorted arcs" indicated by reference numerals 21 in FIGS. 8 and 9 are generated, and it is understood that the anode member is quickly worn by the distorted arcs.

Therefore, the present inventor evaluated various torch heads configurations of this type in order to:

1) spray a plasma gas into a narrow tube member (diameter of 30 mm to 300 mm),
2) use a powder having an average grain diameter of 5 to 45 m as a spraying material,
3) increase the plasma energy to about 30 kw to 45 kw, and
4) suppress distorted arcs from being generated to elongate the lifetime of a positive electrode (anode).

SUMMARY OF THE INVENTION

The present invention has been made on the basis of the above circumstances. It is an object of the present invention to provide a coating that can be satisfactorily formed in plasma spraying in a narrow tube member to make it possible to elongate the lifetimes of electrodes.

In order to achieve this objective as a means which passes through the orifice 16 at a high speed. Since the plasma generation chamber 17 located at the position of the outlet of the orifice 16 is bent at an angle of 90° with respect to the longitudinal axis of the cathode 12, the working gas generates a small turbulent flow and has not been sufficiently thinned at this point. The working gas is gradually thinned while forming a stationary flow between the inner bottom of the plasma generation chamber 17 and the mouth opening 18. This thinning is maximum in the plasma generation chamber 17 located immediately near the mouth opening 18. This is because the region outside of the mouth opening 18 has the atmospheric pressure, and the atmospheric pressure is remarkably lower than the pressure in the plasma gas supply chamber 15.

The working gas in the plasma generation chamber 17 which is immediately near the mouth opening 18 is thinned because the orifice 16 exists. In the orifice 16, the opening area is set to be ⅓ to 1/10 the opening area of the mouth opening 18. This is because when the opening area of the orifice 16 is larger than ⅓ of the opening area of the mouth opening 18, the working gas cannot be effectively thinned immediately near the mouth opening 18. When the opening area of the orifice 16 is smaller than 1/10 of the opening area of the mouth opening 18, it cannot be expected to smoothly inject the working gas.

When a DC voltage is applied across the cathode 12 and the anode member 13, the arc 20 is generated between the cathode 12 and the anode member 13. This arc 20 extends from the cathode 12 to a region where the working gas of the plasma generation chamber 17 is maximally thinned, i.e., a region near the mouth opening 18 of the plasma generation chamber 17 in the torch head 10. More specifically, the arc 20, as shown in FIGS. 1 to 3, is generated from the dial end of the cathode 12 at an angle of about 90°.

One the anode member 13 side at which the arc 20 arrives, as described above, cooling is performed from the outside by the cooling water which enters from the anode cooling water passage 13*a* into the cooling chamber 13*b*. In the plasma generation chamber 17 in the anode member 13, since the working gas which has not been heated stationarily flows, cooling by the working gas is stationarily performed. As a matter of course, no parts are heated by the arc 20, and no parts are worn by the arc 20.

As described above, the arc 20 is generated between the cathode 12 and the inner wall of the plasma generation chamber 17 near the mouth opening 18, i.e., a region near the mouth opening 18 of the anode member 13. When the working gas passes through the plasma generation chamber 17, the working gas is changed into a high-temperature gas plasma by the arc 20. At this time, since the arc 20 extends from the cathode 12 to a position immediately near the mouth opening 18, the working gas is sufficiently changed into a plasma and heated to a high temperature. More specifically, the torch head 10 generates a plasma gas having a high energy.

When the spraying material 30 is supplied, through the spraying material supply tube 14, to the plasma gas discharged from the mouth opening 18, the spraying material 30 goes toward the inner surface of the tube member 40 together with the plasma gas flow. At the same time, energy is given from the high- temperature plasma gas to the spraying material 30 to soften or melt the spraying material 30. When the spraying material 30 collides with the inner surface of the tube member 40, the spraying material 30 is further heated by the kinetic energy. The spraying material 30 sufficiently adheres to the inner surface of the tube member 40 without being reflected or rebounded from the inner surface, and the coating 31 is formed without wasting the spraying material 30.

A torch head 10 according to the first aspect can achieve the following operations or advantages:

1) Since the arc 20 is generated from the distal end of the cathode 12 at an angle of about 90°, the arc 20 can be sufficiently long, and the plasma energy of the plasma working gas can be made high, i.e., about 30 to 45 kw.
2) Since the above high energy can be obtained, an oxide or a metal oxide having a size of about 5 to 45 $\mu$m can be used as the spraying material 30, and the coating 31 having a sufficient thickness and a sufficient function can be formed.
3) For this reason, although the tube member 40 is narrow, the coating 31 facing an open wall and having a sufficient thickness and a sufficient function can be formed.
4) Since the disturbed arc 21 or a high-temperature plasma is not in direct contact with the anode member 13 constituting the plasma generation chamber 17, the anode member 13 is not worn early, and, consequently, the lifetime of the anode member 13 is long. In the embodiment to be described later, the lifetime is 200 hours.

In order to solve the above problems, as a means according to the second aspect of the invention, in the torch head 10 according to the first aspect, "the longitudinal axes of an orifice 16, a cathode 12 stored in the orifice 16, and a cathode tube 12*a* supporting the cathode 12 are spaced apart from the center of the torch body 11 by a distance which is 5 to 15% the size of the torch body 11 on the opposite side of the mouth opening 18".

More specifically, in the torch head 10 according to the second aspect, the longitudinal axis of the orifice 16, the cathode 12, and the cathode tube 12*a* are spaced apart from the mouth opening 18 as far as possible. In this manner, the arc generated between the cathode 12 and the anode member 13 is elongated.

As a matter of course, "keeping away" of the respective members from the mouth opening 18 must be performed in the torch body 11 having only a limited space. For this reason, the actual distance between the mouth opening 18 and the respective members must be about 10 to 15% the size (outer diameter) of the torch body 11. More specifically, when the distance of the "keeping away" from the center of the torch body 11 is smaller than 5% the diameter of the torch body 11, a substantial advantage cannot be obtained. In contrast to this, it is almost impossible that the distance is larger than 15% in the limited space of the torch body 11, and spraying on the inner surface of the narrow tube member 40 cannot be performed.

Therefore, the torch head 10 according to the second aspect can achieve the same function as that of the torch head 10 according to the first aspect, as a matter of course, can more elongate the arc 20, can increase a plasma energy even on the inner surface of the narrow tube member 40, and, consequently, can increase and improve the thickness and the function of the coating 31.

BRIEF DESCRIPTION OF THE DRAWINGS

FIGS. 6A and 6B show Sample 1 made by the present inventor, in which FIG. 6A is a partially sectional view and FIG. 6B is a cross-sectional view along a 2—2 line in FIG. 6A.

FIGS. 7A and 7B show Sample 2 made by the present inventor, in which FIG. 7A is a partially sectional view and FIG. 7B is a cross-sectional view along a 3—3 line in FIG. 7A.

DETAILED DESCRIPTION OF CERTAIN PREFERRED EMBODIMENTS

A torch head 10 according to an embodiment in which the present invention is illustrated will be described below. The torch head 10 substantially includes the aspects of the present invention.

Figure 1:
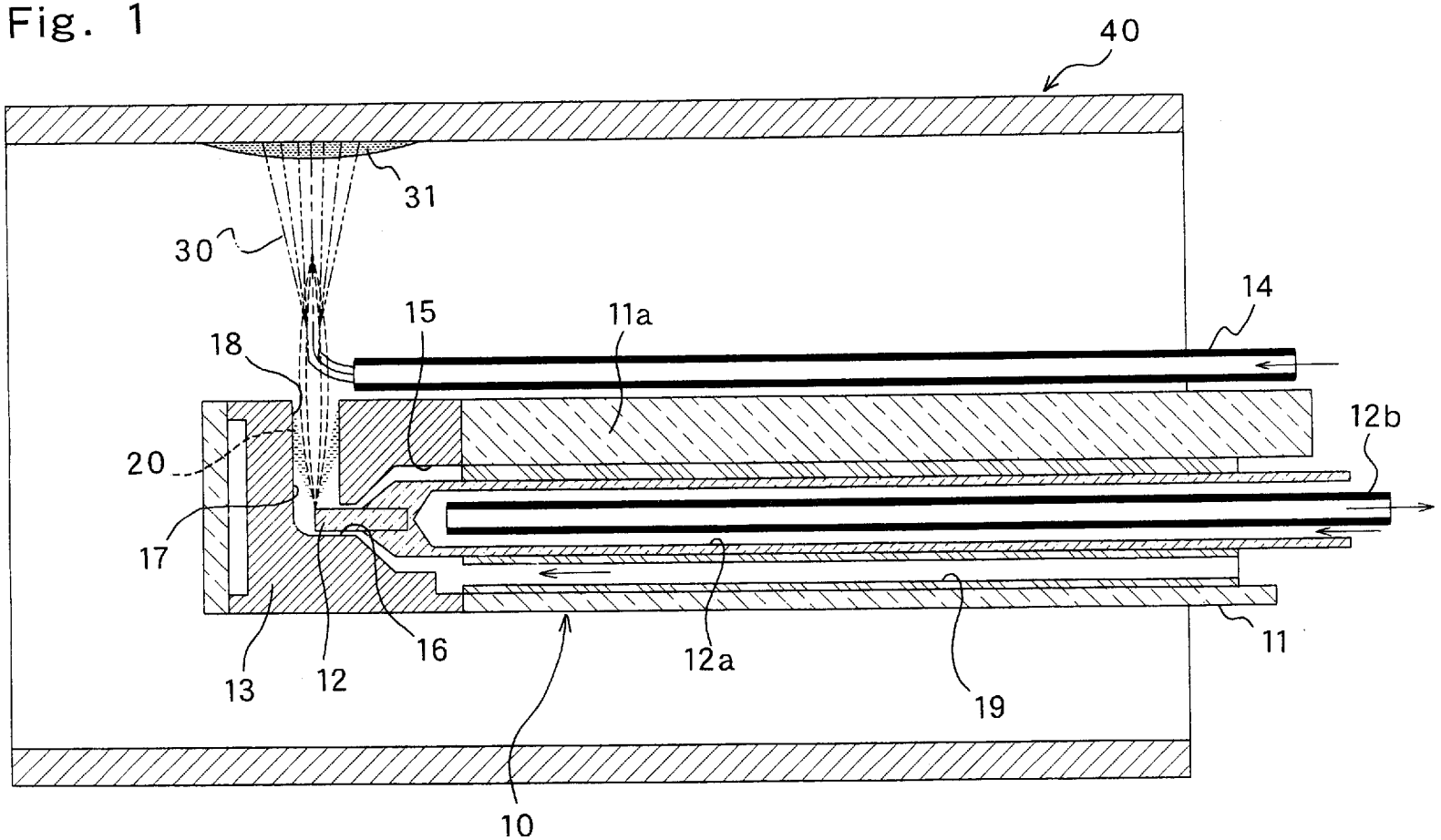
FIG. 1 is an enlarged sectional view of a torch head according to the present invention when the torch head is inserted into a tube member subjected to spraying.

FIG. 1 is a sectional view of the torch head 10 which is to perform spraying in the tube member 40. The tube member 40 is set for the torch head 10 according to this embodiment such that the tube member 40 itself is repeatedly reciprocated and rotated. As a matter of course, to the torch head 10 shown in FIG. 1, a supply of cooling water and a spraying material 30 which is a powder, a power supply, and a supply of working gas are processed from the right in FIG. 1.

The torch head 10 includes a cylindrical torch body 11 having such a diameter (25 to 45 mm in this embodiment) that the torch body 11 can be inserted into the tube member 40, a cathode tube 12*a* accommodated in the torch body 11, an anode cooling water passage 13*a*, and a plasma supply tube 19. The distal end (the left end in FIG. 1) of the torch body 11 is integrated with an anode member 13 having a mouth opening 18. A spraying material supply tube 14 opening toward the mouth opening 18 of the anode member 13 is arranged outside the torch body 11.

Figure 2:
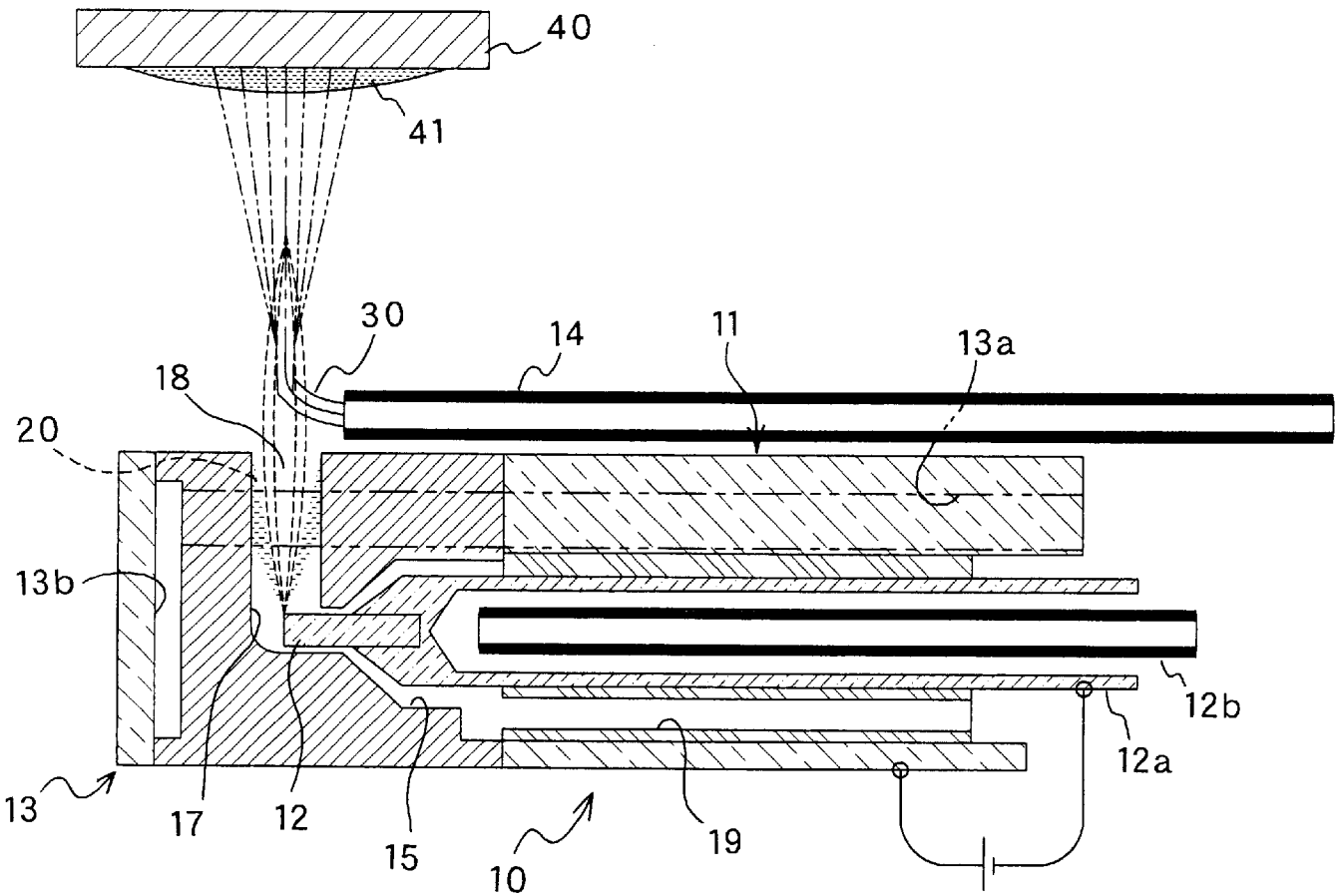
FIG. 2 is a more enlarged sectional view of the torch head.

In the torch head 10 according to this embodiment, the longitudinal axis of the cathode tube 12*a* is spaced apart from the center of the torch body 11 by a distance which is about 10% of the diameter of the torch body 11 on the opposite side of the mouth opening 18, arid a cooling water tube 12*b* is inserted into the cathode tube 12*a*, and the cathode 12 is attached to the distal end of the cathode tube 12*a*. As a matter of course, the cathode tube 12*a*, as shown in FIGS. 1 and 2, is insulated from the torch body 11 and the anode member 13 through an insulator 11*a*.

The distal end of the cathode tube 12*a* is stored in a plasma gas supply chamber 15 formed in the anode member 13 in a non-contact state, and the cathode 12 arranged at the distal end of the cathode tube 12*a* is stored in a non-contact state in an orifice 16 formed deep in the plasma gas supply chamber 15. The distal end of the cathode 12 projects into the plasma generation chamber 17 communicating with the orifice 16, and the projection position of the distal end is substantially set at the center of the plasma generation chamber 17. The longitudinal axis of the plasma generation chamber 17 is bent at an angle of 90° with respect to the longitudinal axis of the orifice 16, so that the direction of the flow of working gas flowing from the orifice 16 is bent at an angle of 90°. The distal end of the plasma generation chamber 17 serves as the mouth opening 18 facing the inner surface of the tube member 40.

The plasma generation chamber 17 according to this embodiment has a diameter of about 6 mm. The diameter is about four times the opening area of the orifice 16 into which the cathode 12 is inserted. The longitudinal axis extending from the bent portion of the plasma generation chamber 17 is perpendicular to the direction of the longitudinal axis of the torch body 11 as described above.

To the mouth opening 18 at the distal end of the plasma generation chamber 17, the spraying material 30 which is a powder is supplied by the spraying material supply tube 14 in the transverse direction. The spraying material 30 used in the torch head 10 according to this embodiment is alumina having an average grain size of 20 $\mu$m.

The anode member 13 according to this embodiment, as indicated by a dotted line in FIG. 2, supplies cooling water into the cooling chamber 13*b* formed at the distal end of the anode member 13 through the forward anode cooling water passage 13*a* arranged in the torch body 11. The cooling water which exhibits a cooling function is exhausted to the outside through the backward anode cooling water passage 13*a* communicating with the cooling chamber 13*b*.

Figure 3:
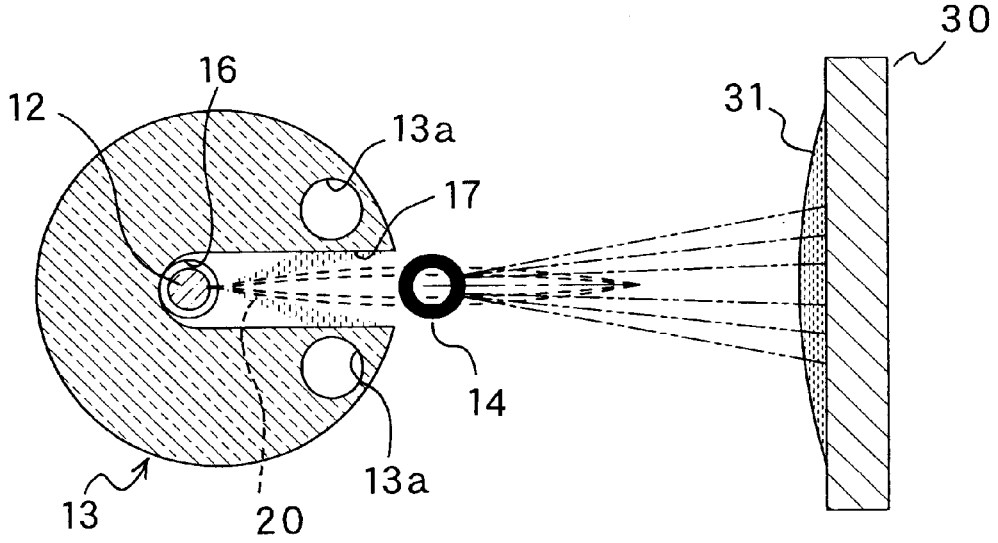
FIG. 3 is a cross-sectional view along a 1—1 line in FIG. 2.
Figure 4:
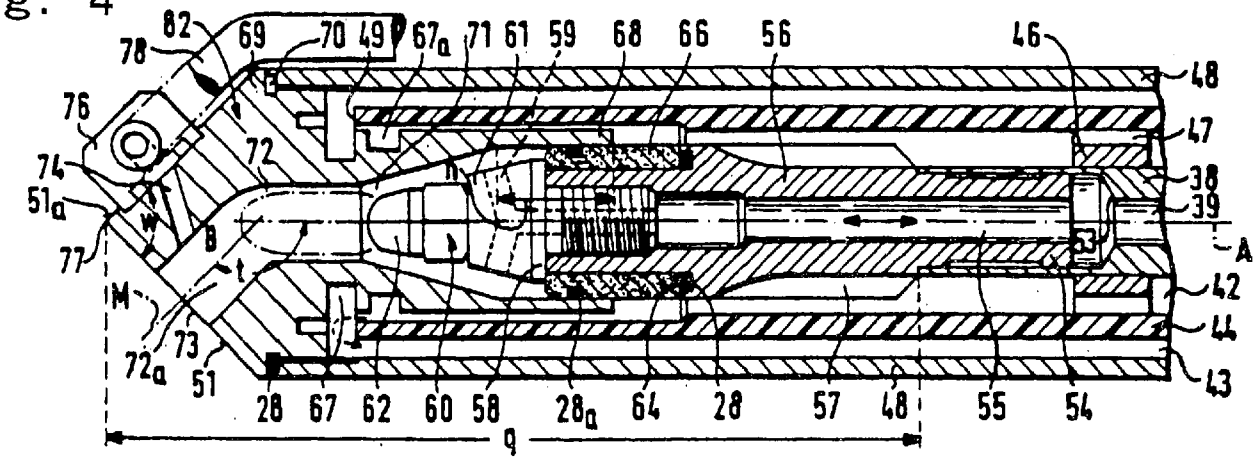
FIG. 4 is a partially sectional view showing a prior art.
Figure 5:
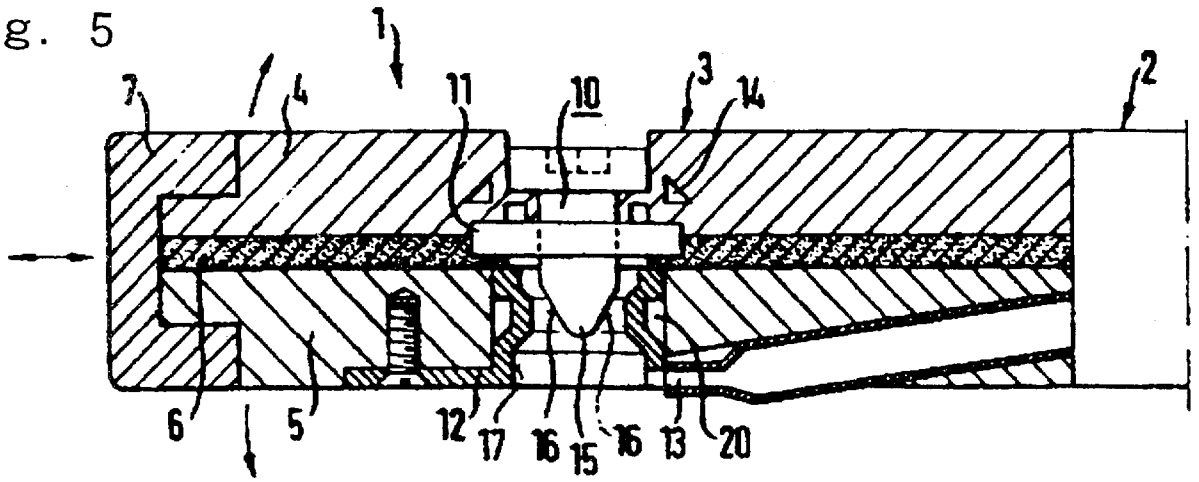
FIG. 5 is a partially sectional view showing another prior art.
Figure 6:
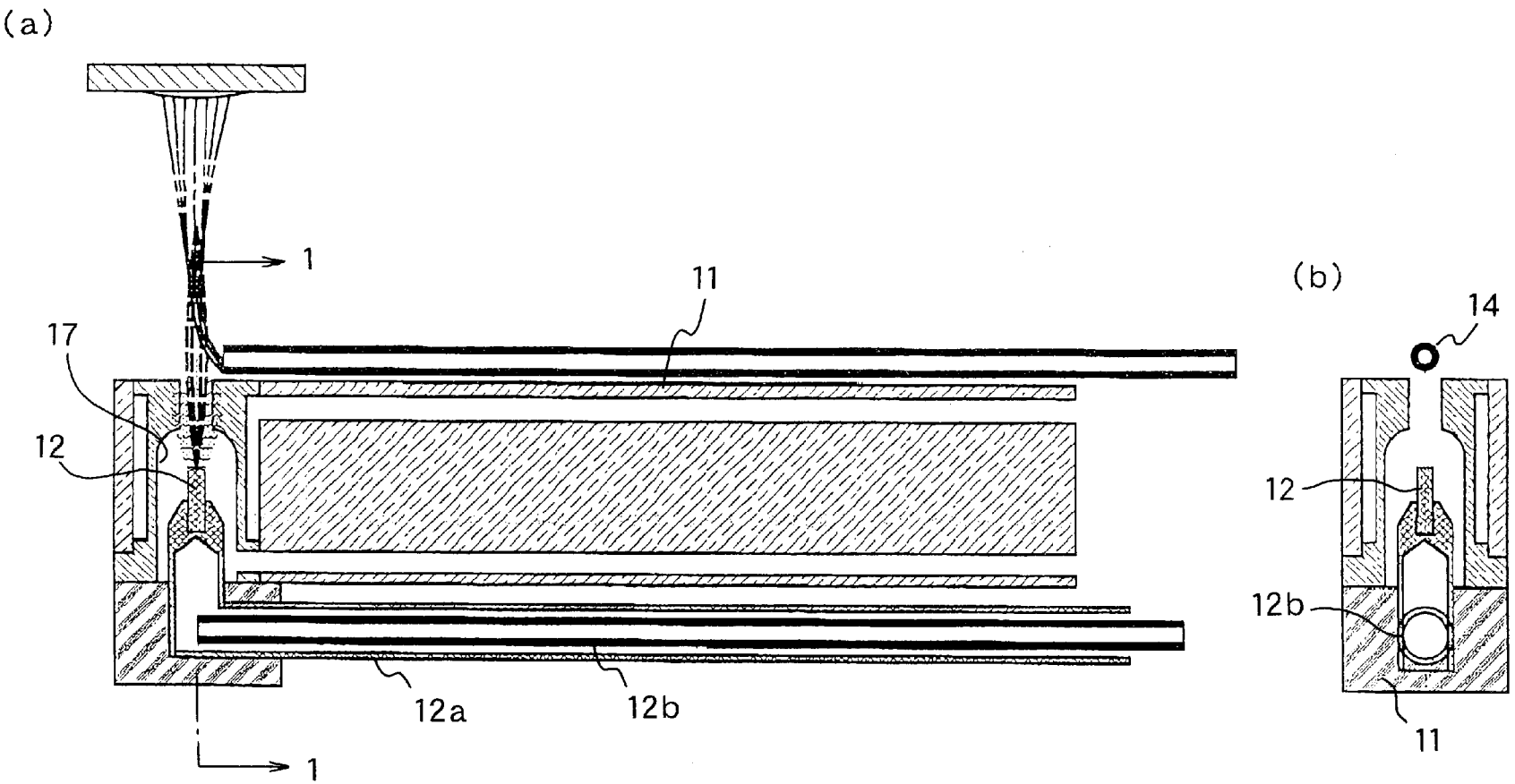
Figure 7:
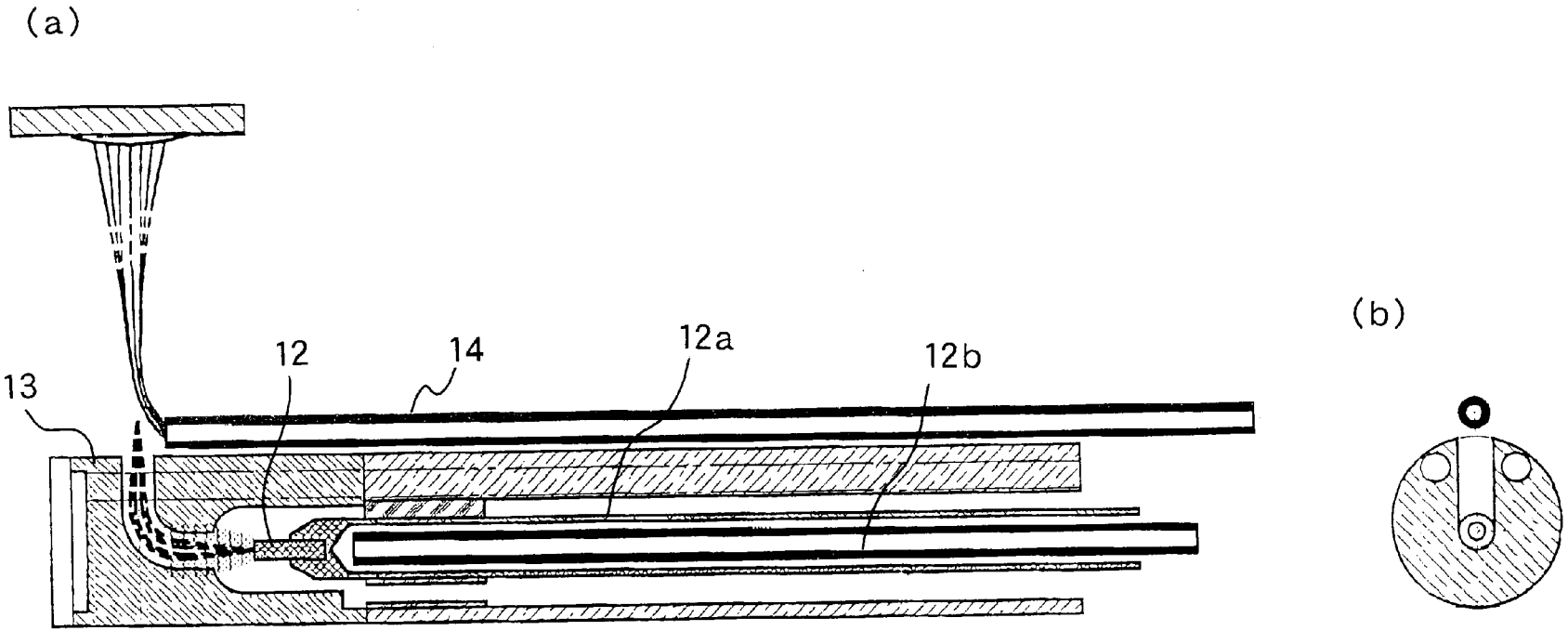
Figure 8:
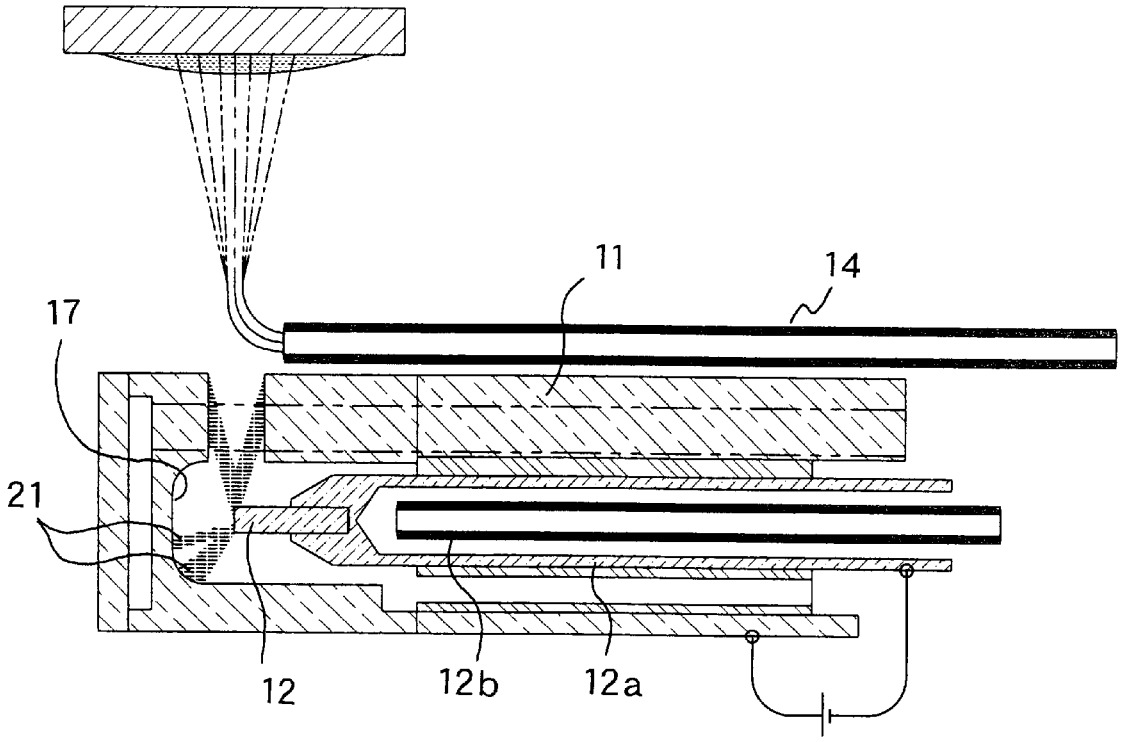
FIG. 8 is a partially sectional view showing Sample 3 made by the present inventor.
Figure 9:
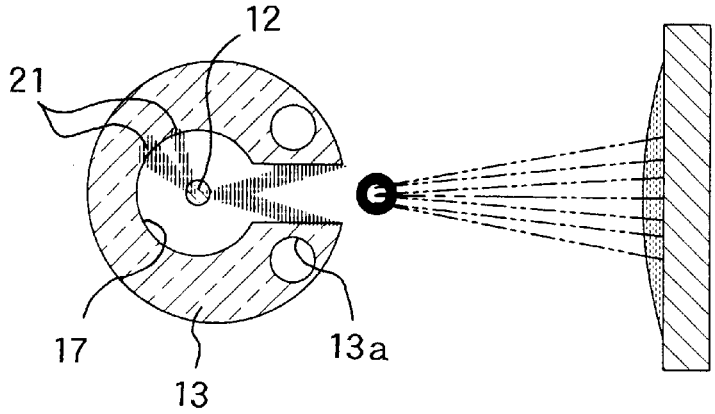
FIG. 9 is a cross-sectional view along a 4—4 line in FIG. 8.

As a result of the above configuration, in the torch head 10, an arc 20 between the cathode 12 and the anode member 13 is generated substantially perpendicular to the longitudinal axis of the cathode 12. For this reason, as shown in FIGS. 1 to 3, the arc 20 is generated such that the arc 20 long extends from the cathode 12 to a position immediately near the mouth opening 18, a change from working gas into a plasma and an increase in energy of the working gas are achieved. When the spraying material 30 is injected into the plasma gas, the spraying material 30 is changed into droplets by the heat or the like of the plasma gas, and the coating 31 having a relatively large thickness is efficiently formed on the inner surface of the tube member 40.

Spraying is performed by using the torch head 10 according to this embodiment under the following conditions:

Material and average grain size of spraying material: alumina, 20 $\mu$m;

Supply of cooling water: 20 m/min;

Applied voltage and current value: 60 volts, 700 ampere (42 kw);

Material tube and inner diameter of tube member 40: cast-iron tube, 50 mm; and Diameter of torch body 11:26 to 32 mm.

The thickness of the coating 31 formed by the above items was 500 $\mu$m or more, an impurity such as nitride was rarely detected on the surface of the coating 31. In addition, when the torch head 10 is used under the above conditions, the endurance time of the coating 31 was about 200 hours.

As has been described above, as illustrated in the above embodiment, the present invention has the following characteristic feature, "the torch head 10 for plasma spraying which is inserted into the tube member 40 to form the coating 31 on the inner surface of the tube member 40 by plasma spraying including the torch body 11 which is inserted into the tube member 40, the cathode tube 12*a* which is arranged in the torch body 11 such that the longitudinal axis of the cathode tube 12*a* is aligned to the longitudinal axis of the torch body 11 and which has the cathode 12 at the distal end of the cathode tube 12*a*, the anode member 13 which is arranged on the distal end side of the cathode tube 12*a*, and the spraying material supply tube 14 which opens toward the mouth opening 18 formed in the anode member 13 and which is arranged outside the torch body 11, wherein, in the anode member 13, the plasma gas supply chamber 15 in which the front end of the cathode tube 12*a* is stored in a non-contact state, the orifice 16 which communicates with the plasma gas supply chamber 15 and in which the cathode 12 is stored in a non-contact state, and the plasma generation chamber 17 which communicates with the orifice 16, which has a longitudinal axis substantially perpendicular to the longitudinal axis of the torch body 11, and which has the mouth opening 18 are formed, the opening area of the orifice 16 when the anode is inserted is made ⅓ to 1/10 the opening areas of the plasma generation chamber 17 and the mouth opening 18 so that the arc 20 from the distal end of the cathode 12 is generated within a range of 0° to 40° with respect to the longitudinal axis of the plasma generation chamber 17 perpendicular to the longitudinal axis of the cathode 12. In this manner, when spraying in a narrow tube member is performed, a satisfactory coating can be obtained, and the lifetimes of electrodes can be elongated.

In the torch head 10, when

"the longitudinal axes of the orifice 16, the cathode 12 stored in the orifice 16, and the cathode tube 12*a* supporting the cathode 12 are spaced apart from the center of the torch body 11 by a distance which is 5 to 15% of the size of the torch body 11 on the opposite side of the mouth opening 18", in addition to the above advantages, the arc 20 can be more elongated, and a high energy can be obtained. The coating 31 can be more effectively formed.

What is claimed is:

1. A torch head for plasma spraying which is inserted into a tube member to form a coating on the inner surface of the tube member by plasma spraying, comprising:

a torch body which is inserted into the tube member;

a cathode tube which is arranged in the torch body such that the longitudinal axis of the cathode tube is aligned to the longitudinal axis of the torch body and which has a cathode at the distal end of the cathode tube;

an anode member which is arranged on the distal end side of the cathode tube; and a spraying material supply tube which opens toward a mouth opening formed in the anode member and which is arranged outside the torch body, wherein, in the anode member, a plasma gas supply chamber in which the front end of the cathode tube is present in a non-contact state, an orifice which communicates with the plasma gas supply chamber and in which the cathode is present in a non-contact state, and a plasma generation chamber which communicates with the orifice, which has a longitudinal axis substantially perpendicular to the longitudinal axis of the torch body, and which has the mouth opening are formed, the opening area of the orifice when the anode is inserted is made ⅓ to 1/10 of the opening areas of the plasma generation chamber and the mouth opening so that an arc from the distal end of the cathode is generated within a range of 0° to 40° with respect to the longitudinal axis of the plasma generation chamber perpendicular to the longitudinal axis of the cathode.

2. A torch head according to claim 1, wherein the longitudinal axes of an orifice, a cathode present in the orifice, and a cathode tube for supporting the cathode are spaced apart from the center of the torch body by a distance which is 5 to 15% of the outer diameter of the torch body on the opposite side of the mouth opening.

* * * * *